US006502284B2

(12) United States Patent
Juda et al.

(10) Patent No.: US 6,502,284 B2
(45) **Date of Patent: *Jan. 7, 2003**

(54) CLOTHING PROTECTIVE DEVICE

(75) Inventors: Daniel P. Juda, New York, NY (US); Edward Sullivan, Huntington Station, NY (US)

(73) Assignee: Idego, Inc., New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/730,638

(22) Filed: Dec. 6, 2000

(65) Prior Publication Data

US 2002/0020044 A1 Feb. 21, 2002

Related U.S. Application Data

(63) Continuation-in-part of application No. 09/225,807, filed on Jan. 5, 1999, now Pat. No. 6,182,335.

(51) Int. Cl.[7] ..... A41D 25/04; A45F 5/04; F16G 11/00

(52) U.S. Cl. ..... 24/7; 24/3.4; 24/9; 24/66.9; 24/115 H

(58) Field of Search ..... 24/7, 9, 66.9, 115 H, 24/3.4

(56) References Cited

U.S. PATENT DOCUMENTS

| | | | | | |
|---|---|---|---|---|---|
| 324,039 | A | | 8/1885 | Nelson | |
| 434,857 | A | * | 8/1890 | Adamson | 24/9 |
| 598,870 | A | | 2/1898 | Hoaland et al. | |
| 1,146,934 | A | * | 7/1915 | Gleeson | 24/115 H |
| 1,669,983 | A | | 5/1928 | Humphrey | |
| 1,725,748 | A | | 8/1929 | Alexander | |
| 2,291,089 | A | * | 7/1942 | Okun | 24/3.4 |
| 2,861,313 | A | | 11/1958 | Ruf | |
| 3,453,698 | A | | 7/1969 | Mosby | |
| 3,813,737 | A | | 6/1974 | Larsen | |
| 4,425,680 | A | | 1/1984 | Basseches et al. | |
| 4,447,950 | A | * | 5/1984 | Mizelle | 30/155 |
| 4,587,692 | A | | 5/1986 | Kaderabek | |
| 4,953,809 | A | | 9/1990 | Barrus | |
| 5,008,981 | A | | 4/1991 | Smithson | |
| 5,191,681 | A | | 3/1993 | Loken et al. | |
| 5,509,616 | A | | 4/1996 | Millen, Jr. et al. | |
| 5,852,849 | A | * | 12/1998 | Lansing et al. | 24/3.4 |
| 5,884,333 | A | * | 3/1999 | Soliman | 24/66.9 |

* cited by examiner

*Primary Examiner*—Victor Sakran
(74) *Attorney, Agent, or Firm*—Scully, Scott, Murphy & Presser

(57) ABSTRACT

A clothing protective device which is particularly adapted to be worn by a man, woman or child, and which in particular will assist in the protection of clothing while dining or engaging in other activities which may stain clothes. In essence, the device is essentially in the form of a so-called napkin holder which can be readily transported in a clothing pocket or a purse.

10 Claims, 2 Drawing Sheets

CLOTHING PROTECTIVE DEVICE

CROSS-REFERENCE TO RELATED APPLICATIONS

This application is a Continuation-in-part application of the U.S. patent application Ser. No. 09/225,807; filed on Jan. 5, 1999. Now U.S. Pat No. 6,182,335.

BACKGROUND OF THE INVENTION

1. Field of the Invention

The present invention relates to a clothing protective device which is particularly adapted to be worn by a person, such as a man, woman or child, and which in particular will assist in the protection of clothing while dining. In essence, the device is essentially in the form of a so-called napkin holder which can be readily transported in a clothing pocket or a purse and which is imparted a large number of uses and/or decorative attributes in addition to being merely a clothing protective device.

In essence, various types of clothing protective devices, especially in the form of napkin holders which may be worn about the neck of the user during dining are currently known and in widespread use. Among such devices, of a rather primitive nature are the so-called napkins or bibs which are adapted to be tied about the neck of a wearer, or which may be provided with button holes so as to be attachable to a button on a shirtfront during dining, and which are relatively unsightly when worn in public locations or more sophisticated dining establishments.

Currently a number of clothing protective devices of this nature; in essence, which are adapted to be worn about the neck of a wearer during desired periods of time; for example, such as when dining or the like, are known in the art.

2. Discussion of the Prior Art

Among the devices adapted to protect clothing during dining or similar occasions are the napkin clip of Basseches et al. U.S. Pat. No. 4,425,680. In that instance, a clip which may be attached to an upper clothing portion below the chin of a wearer has clamping structures which are adapted to engage a napkin corner which is passed through a slot so as to be clipped to the clothing. This, however only protects a narrow front portion of the clothing of the wearer and, in essence, does not provide for any adjustability with regard to the different types of clothing, or the size of the wearer; for example, that of a man compared to woman or a child. Consequently, Basseches at el. discloses a napkin clip which is only of relatively limited applicability.

Lokken U.S. Pat. No. 5,191,681 discloses a napkin or drape holder which is in the form of a spring-like first plastic member and a spring-like second plastic member of collinear proportion adapted to be engaged so as to wedge a hinge structure therebetween, the latter of which may be attached to a napkin or a drape. When attached to a napkin, the ring-like element may be positioned about the neck of wearer during dining. This however, presents, a complex and uncomfortable structure which is not suspectable of large scale utilization in view of its lack of adjustability to the neck of a child or woman where it may create problems as to sensitivity and discomfort. Similarly, Kaderabek U.S. Pat. No. 4,587,692 discloses a universal napkin support in the form of two elastic circular arm bands which are adapted to be position about the neck of a wearer, and wherein clip members at side portions thereof are adapted to engage a clothing or napkin article so as to be suspended from the neck of the wearer. Again, as in the previously discussed patent to Lokken, this would provide a large degree of discomfort and lack of adjustability for the neck of a woman or child of tender years.

Other devices of that type are disclosed in Millen Jr. et al. U.S. Pat. No. 5,509,616; Simthson U.S. Pat. No. 5,008,981; Barrus U.S. Pat. No. 4,953,809; Larson U.S. Pat. No. 3,813,737; Mosby U.S. Pat. No. 3,453,698; Reef U.S. Pat. No. 2,861,313; Alexander U.S. Pat. No. 1,725,748; Huphrey U.S. Pat. No. 1,669,983; Hoagland U.S. Pat. No. 598,872; and Nelson U.S. Pat. No. 324,039.

None of the foregoing clothing protective devices and related types of operative structures disclose or suggest the construction and physical applications of the present inventive clothing protective device.

SUMMARY OF THE INVENTION

Accordingly, in order to clearly and advantageously distinguish over the foregoing, pursuant to the present invention a clothing protective device includes a small case, generally in the form of a cylindrical element, constituted of two separable halves attached by an outwardly extendable string or chain upon separation of the halves and subsequently foldably insertable therein upon assembly of the halves, and incorporates elements for the clamping attachment of a clothing protective article to the device, such as a napkin or the like surface-covering article.

The item aids in the protection of clothing while dining, the small casing assembly allows the outer cylindrical elements to be made of any type of material, i.e. wood, plastic, metal, glass, and which is easily transported in a clothing pocket or purse during non-use thereof. The two halves of the symmetric container split apart to expose an individual clip on the innermost planar surface of each half. The clips hold a user supplied napkin in place during a meal or while engaging in activities which would normally stain clothing. The two halves of the case are connected by means of a string or decorative chain which is adapted to be draped around the neck of the user, who attaches each clip to one side of a napkin which can then be easily arranged to vary the napkin position. When finished dining the two halves are simply unclipped by the user from the napkin, and by suitable manipulation, the string or decorative chain length which is outside of the container, is adapted to be folded or dropped into the interior of at least one of the cylindrical casing elements, and concealed when the two halves are placed together.

The device may also be worn as a necklace by means of the decorative chain. The kinds of materials that can be used in manufacturing the device can vary as to the manner in which it is intended to be sold and assist to classify the clothing protective device as either as a novelty, toy or jewelry which may be either expensive or inexpensive costume jewelry in nature. The extreme outer cylindrical surfaces of both halves, of preferably this particular design, are flat and parallel to each other and can provide a smooth face for decorative engraving, in the event a recess for the application of a picture or mirror or other decorative indicia is not desired for different device models.

Accordingly, it is an object of the present invention to provide a novel clothing protective device comprising a casing including separable halves interconnected by an outwardly extendable string or decorative chain interconnecting the halve, and which includes clip structure for clampingly engaging a napkin or similar clothing protective article.

Another object of the present invention is to provide a casing consisting of mating casing halves which are adapted to be carried in closed condition in a clothing pocket or a purse during non-use thereof, and which may be readily removed therefrom and placed about the neck of the wearer by being separated while remaining attached by an outwardly extendable string or decorative chain so as to engage a clothing protective article, such as a napkin, while the user is dining or otherwise engage in potential clothing soiling activity.

BRIEF DESCRIPTION OF THE DRAWINGS

Reference may now be had to the following detailed description of a preferred embodiment of the invention, taken in conjunction with the accompanying drawings; in which.

DETAILED DESCRIPTION OF THE PREFERRED EMBODIMENT

Figure 1:
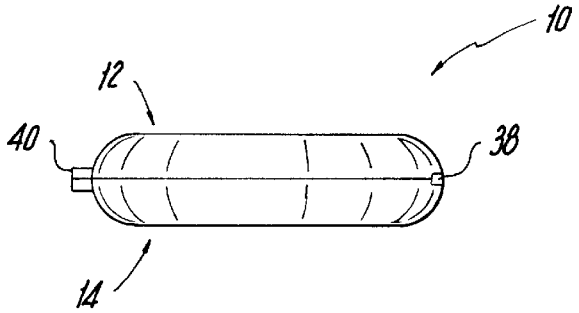
FIG. 1 illustrates a side view of the mating casing halves of the inventive clothing protective device shown in the closed position of non-use.
Figure 2:
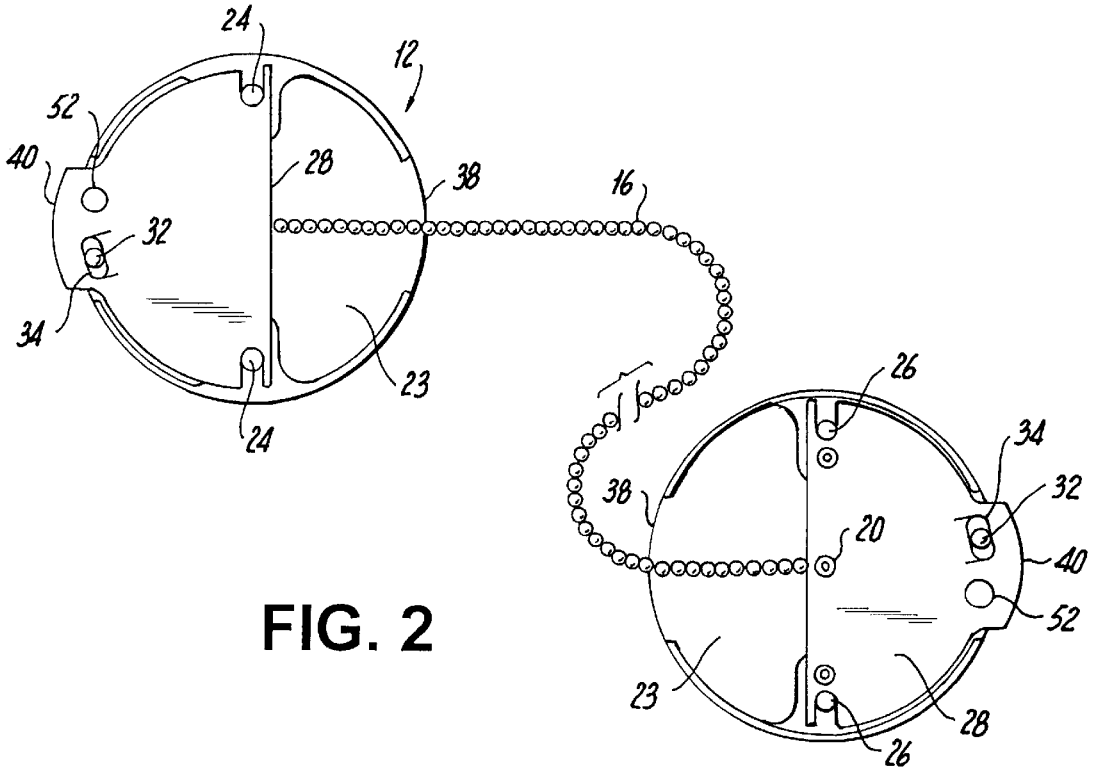
FIG. 2 illustrates a plan view of the interior of each of the casing halves shown in their separated condition, with the article attaching clips being in their closed positions.
Figure 3:
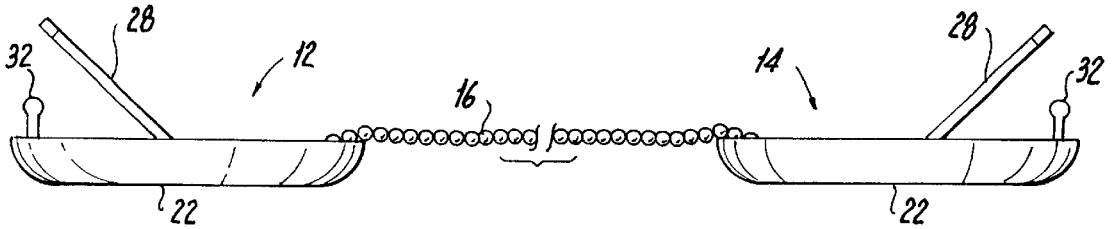
FIG. 3 illustrates a side view of casing halves of FIG. 2 in the clip-opened position.
Figure 4A:
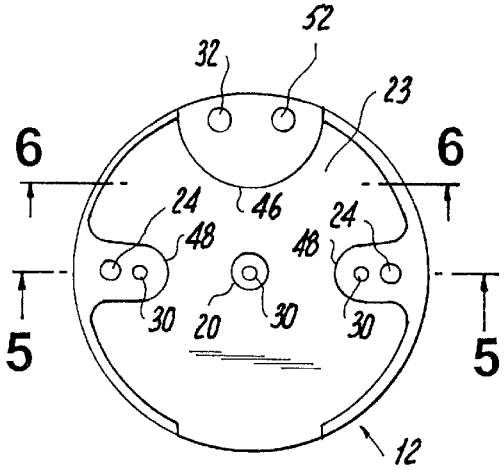
FIGS. 4*a* and 4*b* illustrate respectively, internal details of the casing halves.
Figure 4B:
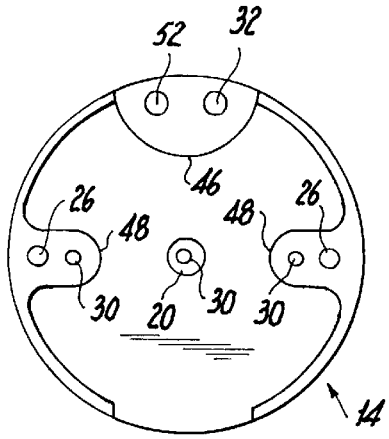
Figure 5:
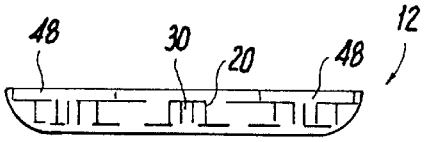
FIG. 5 illustrates a section taken along line 5—5 in FIG. 4*a;*
Figure 6:
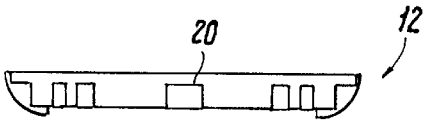
FIG. 6 illustrates a sectional view similar to FIG. 5 with various elements of the internal components shown removed for purposes of clarity.
Figure 7:
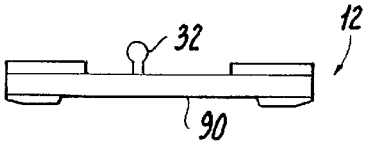
FIG. 7 illustrates a sectional view taken along line 6—6 in FIG. 4*a;*

Referring in particular to the drawings, and as shown FIGS. 1 to 3 there is illustrated the novel clothing protective 10 device wherein two mating casing halves 12, 14 of an essentially identical external configuration are adapted to be interconnected by means of a string, or preferably a decorative chain 16, which is attached at opposite ends thereof to upstanding posts or center structure 18, 20 in each of cup-shaped casing halves 12, 14, as more clearly illustrated in FIGS. 4*a* and 4*b*.

As shown, each of the cup-shaped casing halves 12, 14 has a generally flat exterior surface 22 and a hollow interior configuration, with each of the casing halves being essentially identical to each other, with the exception that one casing half 12 includes locating protrusions 24 for mating with holes 26 in the other casing half 14. These features are, in particular utilized for facilitating the assembly of the two cup-shaped casing halves 12, 14 when not in use, as illustrated in FIG. 1, or when worn as a pendant.

Also illustrated in FIG. 3 is the side edge view of each napkin-engaging clip 28, the latter of which is of a generally semi-circular plate shaped configuration, as more closely explained and represented hereinbelow in connection with FIGS. 8*a* and 8*b* of the drawings. Each of the clips is fastened to the therewith associated casing half 12 or 14 by means of suitable center post support and pin connectors 30, which are spaced so as to pivotally attach the napkin clips 28 to each respective casing half, as shown in FIG. 2 of the drawings.

The casing halves 12, 14 each include upstanding posts with enlarged head portions or ball-standoffs 32 which are adapted to extend through slotted apertures 34, and in the raised or upward pivoted positions thereof, as shown in FIG. 3 of the drawings, facilitate a napkin (not shown) to be engaged intermediate the napkin clip 28 and the post 32 whereby upon the napkin clip being pushed downwardly so as to cause the slotted aperture 34 therein to be engaged over the raised ball-standoff of the post 32, the particular napkin material portion, or similar article, is clampingly engaged therebetween.

The decorative chain or string 16 can be looped about the neck of a user so as to suspend the separated cup-shaped casing halves 12, 14 on the shoulders or chest of the user and thus form a protective structure for the user's clothing. With the decorative chain 16 extended, and the casing halves 12, 14 closed together, the device 10 can be worn as a decorative pendant, especially when the exterior surfaces of one or both casing halves are imparted decorative indicia or the like.

The one cup-shaped casing half contains the protrusions 24 for insertion into the mating holes 26 in the other casing half during closing thereof, so as to upon dropping the chain 16 into the device upon the release of the protective article or napkin from engagement by the ball standoff post 32, will enable the mating casing halves to be latched together. The string or decorative chain 16 is then concealed within the cavities 23 of the closed device 10, but may be outwardly extended due to the presence of a small slot 38 for the extension and/or retraction therein of the decorative chain. The clips 28, as also shown in detail in FIGS. 2, 8*a* and 8*b*, each include an outwardly protruding edge portion 40 to enable the engagement thereof by the fingers of a user so as to be able to either raise or close each of the respective chips, as shown in FIGS. 2 and 3.

As illustrated in FIGS. 4*a* and 4*b*, and FIGS. 5 to 7, showing the details of the interior of each of the casing halves 12, 14, which for the exception of the formation of the holes 26 for mating in one half and the presence of the protrusions 24 in the other half which are engageable in the holes, are the provision of the support post 20 for the clip along a casing centerline and the attachment thereto of the chain 16, there may also be provided a raised semicircular land 46 on each of the casing edges, and radially opposite inwardly extending flanges 48, 50 from the edges thereof. Each of the hands 46 is provided with holes 52 for the respective napkin-engaging ball-standoff post 32 of the mating casing half 12 or 14, and also mounts one of the posts 32 engageable in the oppositely located hole 52.

With regard to the details of each of the essentially identical napkin clips 28, the outermost hemispherical or curved edge thereof includes a protruding tab 40 which may enable the user to have his fingers engage the latter so as exert upward pressure to separate and spread apart the casing halves 12, 14 from each other and to enable the stored chain 16 to slide out through the slot 38 between the edges of the casing halves. The structure also illustrates the slotted aperture 38 which is located directly radially inwardly the outermost protruding edge of the tab 40 which enables for a napkin material to fully cover the end surface of the ball standoff on post 32. This particular slot structure also contains parallel slits 62 at each end of the slot which extends tangentially to the radius of the slot, and which allows for flexibility and squeeze in the interposition of napkins each having a thickness of different gauges. The slot 34 is then pressed over the post 32, and the flap 60 which is formed as a result of the formation will flex away from the post 32 until the napkin clip is positioned clamped down over the ball standoff head portion thereof. At this point in time, the flap or tab 60 will attempt to return to its original position, thus squeezing the napkin into the underside of the upper sphere shape of the ball standoff.

Figure 8A:
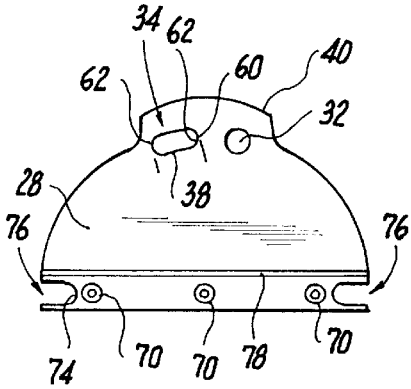
FIGS. 8*a* and 8*b* illustrate, respectively, plan and side views of the clip which is utilized for the clamping engagement of articles by the clothing protective device.
Figure 8B:
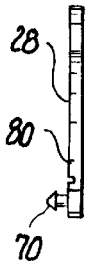

At the horizontal center of each of the napkin clips, as shown in FIGS. 8*a* and 8*b*, there is provided a set of "arrow head" type interlocking protrusions 70, which enable each napkin clip 28 to be permanently mounted into the respective therewith associated casing half 12 or 14. These protrusions 70 are forced inwardly into mating receptacles holes 30 in the flanges and center supports 30 and 20 of each casing half so as to form a secured and permanent sub assembly, as shown in FIG. 2 of the drawings.

At the same centerline 74 of the clips 28 towards the left and right ends at the outermost circumference, there are provided inwardly protruding slots 76 which provide a clearance for the protrusions 24 and holes 26 during the mating closing engagement between the casing halves 12, 14 of the device 10. Formed in parallel relationship along the same centerline 74 of each napkin-engaging clip 28 providing a "hinge point" of a flexible hinge line 78 through the provision of a depression or recess 80 in the clip thickness, so as to allow for flexible upward pivoting of the clips 28 during napkin insertion, and then clamping engagement thereof upon a downwardly pressing action by the user.

Figure 9:
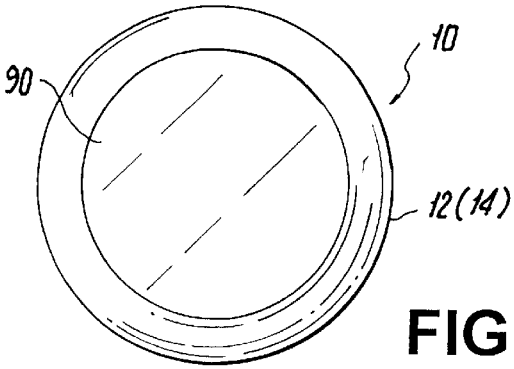
FIG. 9 illustrates a plan view of the exterior of the clothing protective device.

Furthermore, as is ascertainable from FIG. 9 of the drawings, at least one or both of the casing halves 12, 14 may have their outer flat circular surfaces formed with recesses 90, or alternatively protuberances or raised surface portions, which may receive pictures, mirrors, logos, or imparted personal or decorative engravings based on specific user preferences, or these surfaces may also be employed for advertising purposes in identifying particular corporate or commercial enterprises or entities so as to render them attractive to a wide range of potential buyers and users.

While there have been shown and described what are considered to be preferred embodiments of the invention, it will, of course, be understood that various modifications and changes in form or detail could readily be made without departing from the spirit of the invention. It is, therefore, intended that the invention be not limited to the exact form and detail herein shown and described, nor to anything less than the whole of the invention herein disclosed as hereinafter claimed.

What is claimed:

1. A clothing protective device positionable so as to be worn about the neck of a wearer and for clampingly engaging a clothing protective article covering portions of the clothing; said device comprising:

a) a casing structure having first and second mating halves which are manually separable; said mating first and second casing halves being hollow cup-shaped cylindrical members each being of a generally cup-shaped configuration, a string member being manually foldable into the interior of said hollow casing halves upon, said casing halves being positioned in mating contact against each after during periods of non-use to form a closed hollow cylindrical housing, b) said string member interconnecting said first and second casing halves and being extendable outwardly thereof to enable said casing structure to be suspended from the neck of a wearer upon separation of said first and second casing halves; and c) clip means on each of said casing halves adapted to clampingly engage said clothing protective article when said separated first and second casing halves are suspended from the neck of the wearer.

2. A device as claimed in claim 1, wherein pins are provided on one said casing half engageable into apertures in the other casing half for aligning said casing halves in the assembled closed position thereof.

3. A device as claimed in claim 1, wherein at least one of said casing halves includes a recessed outer surface for mounting a decorative mirror.

4. A device as claimed in claim 1, wherein at least one of said casing halves includes an outer recessed surface for mounting a picture or for having a decorative engraving formed therein.

5. A device as claimed in claim 1, wherein at least one of said casing halves includes a raised outer surface.

6. A device as claimed in claim 1, wherein said first and second casing halves are selected from the group of materials consisting of metal, plastic or wood.

7. A device as claimed in claim 1, wherein said string member comprises a decorative chain.

8. A device as claimed in claim 1, wherein each said clip means comprises a generally semi-circular flat plate member having a straight edge thereof fastened along a centerline of the therewith associated casing half, and an outer curvilinear edge including a flap engageable by a user to raise or lower said clip means.

9. A device as claimed in claim 8, wherein each said clip means includes a slot proximate the flap engageable by an upstanding pin in said casing half for clampingly engaging a napkin or clothing-protective article therebetween in a downwardly closed position of said clip means.

10. A device as claimed in claim 8, wherein a weakening line is formed in each said clip means in parallel with said straight edge so as to facilitate opening and closing pivotal movement of each said clip means.

* * * * *